United States Patent [19]

Van Mastrigt

[11] 4,079,983

[45] Mar. 21, 1978

[54] WEIGHT LIFTING EYE AND SOCKET

[75] Inventor: Max Van Mastrigt, Tarzana, Calif.

[73] Assignee: W. C. Dillon and Company, Inc., Van Nuys, Calif.

[21] Appl. No.: 765,784

[22] Filed: Feb. 4, 1977

[51] Int. Cl.[2] ..... B66C 1/66; E04C 5/100

[52] U.S. Cl. ..... 294/89; 52/709; 52/125

[58] Field of Search ..... 294/86 R, 89; 52/125, 52/698–711

[56] References Cited

U.S. PATENT DOCUMENTS

| | | | |
|---|---|---|---|
| 3,404,503 | 10/1968 | Courtois et al. | 294/89 |
| 4,018,470 | 4/1977 | Tye | 294/89 |

*Primary Examiner*—James B. Marbert

*Attorney, Agent, or Firm*—Ralph B. Pastoriza

[57] ABSTRACT

A mandrel is provided with a lifting eye at its upper end for coupling to a hoist and diametrically opposite extending lifting lugs at its lower end. A socket member having a diametrically elongated bore passing completely through the socket member is arranged to be secured in the top surface of a weight to be lifted with the top surface of the socket flush with the top surface of the weight. The socket includes a transverse channel on its bottom end extending at right angles to the diametric elongation of the socket bore. The mandrel can be lowered through the bore with the lugs passing through the diametrically opposite elongated portions and thence rotated 90° after the lugs clear the bottom of the socket, the lugs then being received in the transverse channel. Springs serve to bias the mandrel and lugs upwardly relative to the socket to assure proper seating.

3 Claims, 6 Drawing Figures

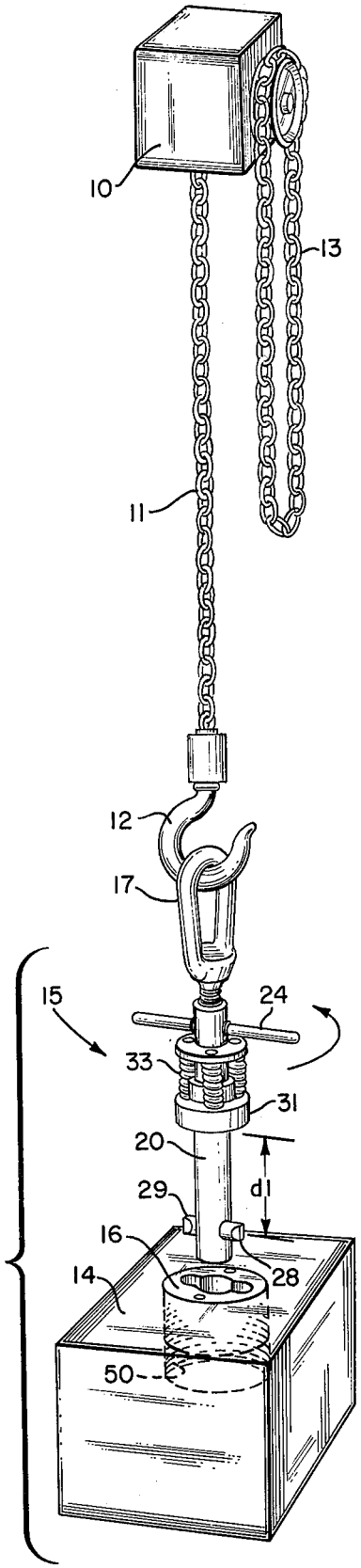
FIG.1
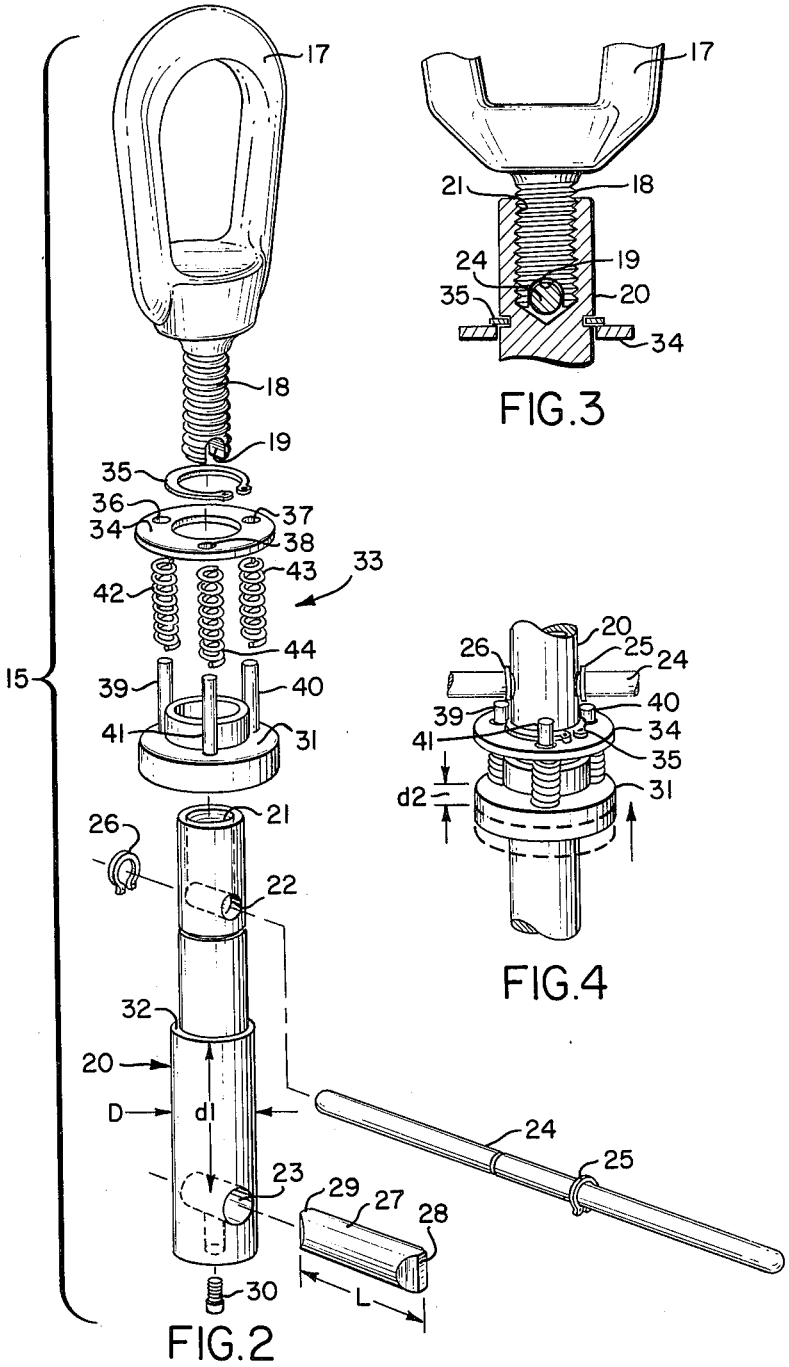
FIG.2
FIG.3
FIG.4
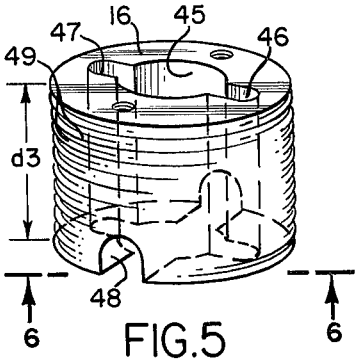
FIG.5
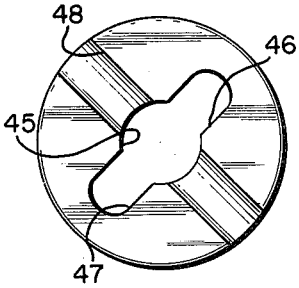
FIG.6

WEIGHT LIFTING EYE AND SOCKET

This invention relates generally to coupling means for connecting a hoist to a weight for moving the weight and more particularly to a quick connect/disconnect weight lifting eye and socket combination for use in moving such weights with a hoist.

BACKGROUND OF THE INVENTION

In the calibration of weighing scales, tensometers, and similar instruments particularly those used for heavy objects, various standard weights of precisely known weight values are used. These standard weights may range anywhere from 100 pounds to 5,000 pounds and greater and normally require heavy duty hoists to lift and move the weights into proper positions for calibrating purposes. For purposes of lifting the weights, they may be provided with conventional eyes which are secured in the top surface of the weight and to which a hoist hook may readily be coupled. On the other hand, the presence of these eyes protruding from each of the standard weights prevents stacking of the weights in a convenient manner, the weights themselves generally being in the shape of rectangular blocks.

To overcome the foregoing stacking problem, various types of socket openings have been provided in the top surface of the weights for cooperation with eyes provided with bayonette couplings for example so that the eyes can be removed from the weights. On the other hand, such disconnectable type eyes as have been available and the geometry of cooperating openings in the weights themselves for receiving the eyes have oftentimes been difficult to manually connect and disconnect. In this respect, any such construction must be capable of withstanding extremely high tension forces particularly when very heavy weights are involved. Accidental uncoupling of the eye from the weight when it is hoisted upwardly and being moved can result in extensive damage and possible serious physical injury to personnel in the area.

In other instances, there are situations where it is necessary to lift heavy weights from a particular environment; for example, in lifting engines from an automobile chassis or in attempting to move other similar type heavy loads wherein projecting eyes for coupling to a hoist could interfere with other components in the environment in which the object is used. In such applications, it would also be desirable to provide a removable eye which can be easily manually connected and disconnected and exhibit the necessary strength and reliability essential for safe movement of the object.

BRIEF DESCRIPTION OF THE PRESENT INVENTION

With the foregoing in mind, the present invention contemplates an improved weight lifting eye and socket combination for coupling to a hoist to enable heavy weights to be moved and wherein the eye itself can be very rapidly connected and disconnected to the weight with assurance that a reliable connection of sufficient strength results.

Briefly, in accord with the invention, a mandrel member is provided with an eye on its upper end and oppositely extending lifting lugs at its lower end. A socket in turn is adapted to be permanently secured in the top surface of a weight, the top surface of the socket itself being flush with the top surface of the weight so that there are no protuberances. The socket has a bore diametrically elongated to receive the mandrel and lugs, the lower end of the socket in the weight having a transverse channel running at right angles to the diametric elongation of the bore so that the lugs can be lowered through the bore beyond the lower end of the socket and the mandrel rotated to position the lugs in alignment with the channel. The assembly is completed by the provision of a retracting means extending between a portion of the mandrel and the top surface of the socket urging the mandrel upwardly relative to the socket when the mandrel has been lowered through the bore beyond the lower end of the socket to thereby assure proper seating of the lugs in the channel.

The foregoing upward movement of the mandrel in seating the lugs in the channel effected by the retracting means is evident to the person coupling the mandrel to the socket so that no ambiguity exists as to whether or not a proper coupling has been achieved. The weight can then be reliably moved by coupling a hoist hook through the eye and lifting the weight.

BRIEF DESCRIPTION OF THE DRAWINGS

A better understanding of this invention will be had by referring to the accompanying drawings in which:

FIG. 1 is a perspective view of a hoist and weight utilizing the weight lifting eye and socket of this invention;

FIG. 2 is an enlarged exploded view of the various components making up the lifting eye;

FIG. 3 is a fragmentary cross section of the eye portion of the exploded view of FIG. 2 in assembled relationship;

FIG. 4 is a fragmentary perspective view of a retracting means shown in the exploded view of FIG. 2 in assembled relationship;

FIG. 5 is an enlarged perspective view of the socket portion of the invention; and, FIG. 6 is a bottom plan view of the socket of FIG. 5 looking in the direction of the arrows 6—6.

DETAILED DESCRIPTION OF THE PREFERRED EMBODIMENT

Referring first to FIG. 1, there is shown a conventional manually operable hoist 10 with hoist chain 11 terminating in hook 12. Weights to be lifted are coupled to the hook 12 and raised or lowered by the usual closed loop chain 13.

Indicated at the lower portion of FIG. 1 is a standard weight 14 which might, for example, be used for calibrating purposes. This standard weight 14 may weigh anywhere from 100 to 5,000 pounds. The weight lifting eye of the present invention is designated generally by the numeral 15 and cooperates with a socket 16 secured in the top surface of the weight 14 with the top surface of the socket flush with the weight as shown.

Referring specifically to the exploded view of FIG. 2, the lifting eye assembly 15 includes an eye member 17 having a lower threaded shaft 18 terminating in a transverse notch 19. A mandrel 20 in turn has an upper threaded opening 21 for threadedly receiving the threaded shaft 18 and includes a first transverse bore 22 adjacent to and intersecting the lower end of the threaded opening 21 as indicated in the phantom lines. Mandrel 20 also includes a second tranverse bore 23 adjacent to its lower end.

A turning handle 24 shown in the exploded view of FIG. 2 is receivable through the first transverse bore 22 in such a manner as to also pass through the notch 19 on the lower end of the threaded shaft 18 after this shaft has been threaded into the opening 21. This passage of the turning handle 24 through the notch 19 is clearly illustrated in the fragmentary cross section of FIG. 3 and serves to prevent unthreading of the eye 17 from the upper portion of the mandrel. The turning handle 24 itself is secured in the bore 22 by simple arc type snap rings 25 and 26.

The foregoing construction thus not only provides a convenient handle for rotating the mandrel but additionally serves to simultaneously lock the threaded shaft and eye securely to the upper portion of the mandrel and thus prevent any inadvertent or accidental unthreading thereof.

Referring to the lower portion of the mandrel 20, there is provided as shown in exploded view an elongated lug member 27 of length greater than the diameter of the mandrel receivable through the second bore 23 such that its opposite ends 28 and 29 project from the entrance and exit openings of the bore to define diametrically opposite lifting lugs. The lug 27 itself is secured centrally in the bore 23 as by a set screw 30 receivable in the bottom of the mandrel 20. The resulting projecting lifting lugs 28 and 29 are clearly shown in FIG. 1.

The weight lifting eye assembly is completed by the provision of retracting means shown exploded above the mandrel and including a collar 31 arranged to slide over the upper portion of the mandrel and seat on a stop means in the form of an annular shoulder 32 defined by an increased diameter portion of the mandrel 20. Cooperating with the collar 31 is a biasing means designated generally by the arrow 33 and including a stop plate 34 also receivable over the upper portion of the mandrel and arranged to be secured to the mandrel against upward movement by arc ring 35. As shown, the stop plate 34 includes three holes 36, 37 and 38 arranged to receive three upstanding guide rods 39, 40 and 41 respectively secured to the collar 31. Compression springs 42, 43 and 44 in turn respectively surround the guide rods between the collar 31 and stop plate 34.

Referring to the fragmentary assembled view of FIG. 4, it will be noted that the biasing means in the form of the compression springs will exert a downward force on the collar 31 seating it against the annular shoulder 32 described in FIG. 2. Sliding upward movement of the collar 31 can take place on the mandrel 20 against the biasing of these springs as indicated by the arrow, the movement being guided by projection of the guide rods 39, 40 and 41 through the openings of the stop plate 34.

Referring now to FIG. 5, details of the socket 16 will be described. As shown, the socket includes a central bore 45 which is diametrically elongated by the provision of diametrically opposite passages 46 and 47. The bore 45 and passages 46 and 47 extend entirely through the socket member as indicated by the phantom lines. The underside of the socket member includes a transverse channel 48 running at right angles to the diametric elongation of the bore as shown.

The foregoing described construction will be clearer by referring to the bottom view of FIG. 6 wherein the channel 48 is clearly illustrated at right angles to the diametric alignment of the passages 46 and 47.

In the particular embodiment illustrated, the socket 16 is provided with exterior threads 49 for threadedly securing the socket in the top surface of the weight 14. In this respect, a bore opening 50 is provided in the top surface of the weight of greater depth than the length of the socket so that the top surface of the socket will be flush with the top surface of the weight and there will still be provided a clear area beneath the bottom surface of the socket.

In FIG. 1, it will be noted that prior to insertion of the mandrel 20 in the socket 16, the distance between the collar 31 and the lugs 28 and 29 when the collar 31 is seated on the annular shoulder of the mandrel is designated d1.

In FIG. 4, the amount of upward movement of the collar 31 relative to the mandrel 20 against the biasing springs is made to be a distance at least equal to d2.

In FIG. 5, the length of the socket 16 is designated d3.

The relationship of the foregoing distances is important. Essentially the first given distance d1 is less than the third given distance d3 by an amount less than the second given distance d2.

OPERATION

Referring to FIG. 1, prior to actually hooking the hoist hook 12 to the eye 17, the mandrel 20 is lowered into the bore in the socket 16 with the lugs 28 and 29 passing down the passages 46 and 47. Because the distance d1 is less than the distance d3, the collar 31 will seat on the upper periphery of the bore 45 of the socket as shown in FIG. 5 before the lugs 28 and 29 extend beyond the lower end of the socket.

In order to secure the coupling of the mandrel to the socket it is now necessary for the operator to exert a downward force on the mandrel as by means of the turning handle 24 which will then urge the collar 31 upwardly against the biasing means 33 a distance at least equal to the second given distance d2. At this point, the lugs 28 and 29 are below the bottom of the socket 16 and the turning handle 24 can then be used to rotate the mandrel 20 90°. The operator will release the downward pressure on the mandrel and the lugs will then snap into the transverse channel 48 as a result of the upward biasing force on the mandrel.

The hook 12 of the hoist can then be inserted through the eye 17 and the weight transported easily and safely. Because of the described construction, it will be evident that the lifting eye and socket is extremely rugged. No appreciable lateral forces are exerted on either the lifting lug itself or the handle 24 so that the referred to set screw and simple arc type snap rings are sufficient to hold these respective elements in place.

After a load has been lifted and transferred to a desired location, the mandrel can readily be released by again simply pushing downwardly on the turning rod 24 to remove the lugs from the transverse channel on the bottom of the socket 16 and the mandrel then rotated by the turning handle 90° to again position the lugs in alignment with the diametrically opposite elongated portions of the bore defined by the passages 46 and 47. Again, the biasing arrangement will cause the lugs to snap into these passage portions when they reach alignment so that it is very simple for the operator to quickly lift out the mandrel preparatory to using the same with another weight or load to be transferred.

As a consequence of all of the foregoing, it will be evident that in the case of standard weights, each such weight may be provided with a socket such as described at 16, the same being permanently threadedly secured into the top surface so that there are no protuberances or projecting portions. The standard weights can thus be easily stacked. The lifting eye and mandrel portion itself can be used with any one of the sockets so that there is no necessity of providing a number of lifting eyes where a number of weights are involved. In other words, the same mandrel and lifting eye fitting can be used over and over again rather than having to provide individual lifting eyes.

Finally, it will be evident that insertion and removal of the eye into and from the socket is very simple and can be carried out very quickly.

I claim:

1. A weight lifting eye and socket for coupling to a hoist to enable heavy weights to be moved, including, in combination:

(a) an eye having a lower threaded shaft terminating in a transverse notch;

(b) a mandrel having an upper threaded opening threadedly receiving said threaded shaft and including a first transverse bore adjacent to and intersecting the lower end of said opening in alignment with said notch, said mandrel further including a second transverse bore adjacent to its lower end;

(c) a turning handle receivable through said first transverse bore and received in said notch to thereby prevent unthreading of said eye from said mandrel;

(d) an elongated lug member of length greater than the diameter of said mandrel receivable through said second bore such that its opposite ends project from the entrance and exit openings of said second bore to define diametrically opposite lifting lugs;

(e) an indexing collar coaxially surrounding said mandrel at a first given distance above said lifting lugs slidable along said mandrel in an upward direction, said mandrel having stop means preventing downward movement of said collar to a position less than first given distance from said lifting lugs;

(f) biasing means coupled to said mandrel in a position to urge said collar downwardly against said stop means, said collar being capable of upward movement against said biasing means through a second given distance relative to said mandrel;

(g) a socket member having a central bore with diametrically opposite passages passing axially a third given distance through said socket member, the underside of said socket member having a diametric channel running transversely to the diametric positions of said passages; and (h) means for securing said socket member in the top surface of a weight to be lifted so that the top of said socket member is flush with said top surface whereby said mandrel may be lowered into said socket with said lifting lugs passing along said passages until said collar seats on the periphery of said bore on the top surface of said socket member, said first given distance being less than said third given distance by an amount less than said second given distance so that downward force on said mandrel moves said collar upwardly against said biasing means through said second given distance to thereby position said lugs beyond the lower end of said socket, rotation of said mandrel through 90° by said handle means positioning said lugs in alignment with said channel so that release of downward force on said mandrel results in said biasing means urging said mandrel upwardly to seat said lifting lugs in said channel so that a hoist hook can then be passed through said eye and said weight lifted.

2. A weight lifting eye according to claim 1, in which said means for securing said socket member includes external threads on said socket member, said weight having a threaded bore threadedly receiving said socket member and of greater depth than said third given distance to leave a space beneath said socket member when its top surface is flush with the top surface of said weight for permitting relative rotation of said lifting lugs beneath said socket.

3. A weight lifting eye and socket according to claim 2, in which said stop means includes an annular shoulder defined by an increased diameter portion of said mandrel against which said collar seats, said biasing means including a stop plate affixed to said mandrel above said collar, said plate having three holes, said collar having three upwardly extending guide rods passing through said holes; and, three compression springs surrounding said rods respectively between said collar and said stop plate such that upward movement of said collar is guided by said rods passing through said openings, said springs being compressed to urge said mandrel upwardly in seating of said lugs in said channel.

* * * * *